US005975889A

United States Patent [19]

Culpepper

[11] Patent Number: 5,975,889

[45] Date of Patent: Nov. 2, 1999

[54] CANDLE SUPPORT APPARATUS

[76] Inventor: Jerry W. Culpepper, 2900 Carrollton Ct., Marietta, Ga. 30066

[21] Appl. No.: 08/802,794

[22] Filed: Feb. 18, 1997

[51] Int. Cl.[6] ..... F23D 3/16

[52] U.S. Cl. ..... 431/296; 431/289; 248/309.2; 248/206.5; 248/205.3

[58] Field of Search ..... 431/289, 296, 431/297; 248/205.3, 309.2, 231.81, 71, 73, 206.5; 362/161, 396, 810, 392

[56] References Cited

U.S. PATENT DOCUMENTS

| | | | |
|---|---|---|---|
| 338,099 | 3/1886 | O'Boylan . | |
| 1,021,921 | 4/1912 | Beckert | 431/297 |
| 1,355,696 | 10/1920 | Ross . | |
| 1,918,098 | 7/1933 | Haley . | |
| 2,365,598 | 12/1944 | Rubin | 431/288 |
| 2,393,767 | 1/1946 | Gould | 431/292 X |
| 2,475,274 | 7/1949 | Beckwith | 248/231.8 X |
| 2,869,812 | 1/1959 | Hamel | 248/511 |
| 3,726,632 | 4/1973 | Connolly | 431/126 |
| 3,918,888 | 11/1975 | Clark et al. | 431/297 |
| 4,877,209 | 10/1989 | Gary | 248/205.3 |

FOREIGN PATENT DOCUMENTS

| | | | |
|---|---|---|---|
| 1121886 | 10/1956 | France | 362/396 |
| 1303735 | 10/1962 | France | 362/161 |
| 68184 | 3/1892 | Germany | 431/296 |
| 685586 | 11/1939 | Germany | 362/161 |
| 20282 | 9/1896 | United Kingdom | 431/297 |
| 17518 | 2/1908 | United Kingdom | 362/159 |

*Primary Examiner*—Carl D. Price
*Attorney, Agent, or Firm*—Rodger H. Flagg

[57] ABSTRACT

A candle support apparatus which is adapted for securement to a bottle cap, package, container or other gift, comprising a candle socket, and at least two elongated, resilient arms radially extending from the candle socket. The resilient arms have depending arm portions with an inclined tab inwardly disposed at the distal end of each depending arm, to secure the candle support apparatus about an unopened bottle cap secured to a bottle. A suitable adhesive is positioned beneath the candle socket to provide additional means of securement. A detent is provided for ease of breaking the resilient arms from the candle socket, to enable the user to alternately secure the candle support apparatus to a suitable object, such as a package, jar, can, container or other gift. A drip catching disc may be secured beneath the candle socket to catch drips from the lighted candle. The drip catching disc preferably has a raised outer periphery for ease of retaining candle drips.

20 Claims, 3 Drawing Sheets

CANDLE SUPPORT APPARATUS

BACKGROUND OF THE INVENTION

Candle holders for supporting a candle from a horizontal or vertical surface, such as a table or wall, are well known in the art. Some prior art devices disclose placing a candle in the neck of a bottle, or disclose apparatus for supporting a candle from an apparatus extending within the neck of a bottle.

This invention is directed to supporting a candle upon an unopened bottle cap, and is further adapted to supporting a candle upon any suitable object, such as a bottle, jar, can, or container.

U.S. Pat. No. 3,726,632 issued to Gerardine Connolly on Apr. 10, 1973 is representative of the prior art disclosing a candle holder which is supported from within the neck of a bottle. In order to use this candle holder, the bottle must be previously opened, and the contents preferably removed, as dripping wax from the candle may enter the neck of the bottle, and thus contaminate the liquid contents of the bottle.

U.S. Pat. No. 3,918,888 discloses a candle stabilizing device for insertion into the socket of a candle holder, in order to support candles of various diameters. The device includes a circular base having four circumferentially spaced upstanding arms along the base wall sized to engage the candle therebetween. The arms are sized to snugly fit within the socket of a candle holder.

U.S. Pat. No. 338,099 issued to B. O'Boylan on Mar. 16, 1886 discloses a candle holder having a disk with tabs extending above the disc to support the candle, and tabs extending beneath the disk for insertion within a suitable aperture, such as a candlestick, for support of the candle holder above the aperture.

U.S. Pat. No. 1,355,696 issued to R. Ross on Oct. 12, 1920 discloses a candle holder having a strip "C" which is bent into a ring for insertion within an aperture in a candle stick, with three or more tongue pieces extending from the upper surface of the ring. The tongue pieces are bent to support the candle holder within the candle stick socket, to provide a ventilated candle holder.

U.S. Pat. No. 1,021,921 issued to H. Deckert on Apr. 2, 1912, discloses a candle holder formed of a plurality of resilient members, each resilient member having an upwardly and inwardly bent end forming a portion of a socket for supporting the candle, and downwardly bent opposing ends, for insertion into a hollow holder.

U.S. Pat. No. 1,918,098 issued to C. Haley on Jul. 11, 1933, discloses a candle holder having a drip plate from which integral outwardly extending and spaced arms having longitudinally V-shaped grooves which bite into the candle to support a candle therebetween. V-shaped hooks on the distal ends are positioned to support drapery, a shade or a globe. The drip plate has a central aperture for securing the drip plate to a plug, sized for insertion within a socket.

SUMMARY OF THE INVENTION

The present invention is directed to a candle support apparatus which is easily secured upon the cap of an unopened bottle, jar or container, which enables the user to present the object, such as a gift in a festive manner. This candle support apparatus is designed to be used on unopened beverage bottles or cans, such as containers for beer, wine, champagne, coolers, soft drinks, etc. The candle support apparatus disclosed herein may also be adapted for use with unopened can goods, bottles, jars, packages and containers, containing a wide range of consumer products, such as gifts, jewelry, perfume, lotion, edible goods, drinks, clothes, gags, and other items presented on a festive occasion, such as birthdays, holidays, celebrations, special occasions, etc.

The above mentioned and other features and objects of the invention, and the manner of attaining them will be best understood by reference to the following description of an embodiment of the invention, when considered in conjunction with the accompanying drawings.

DETAILED DESCRIPTION OF THE PREFERRED EMBODIMENT

Figure 1:
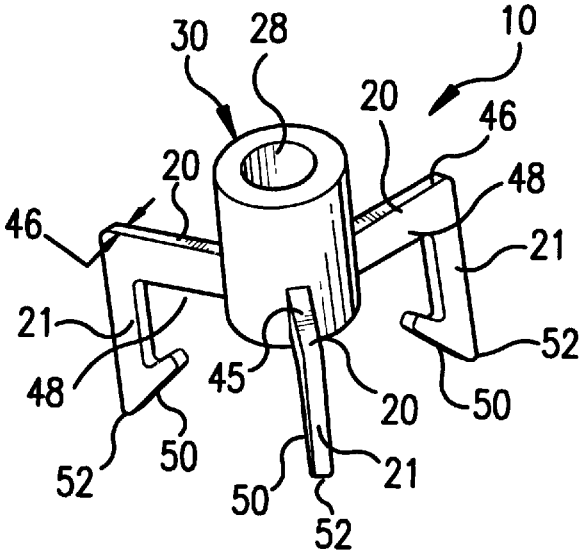
FIG. 1 is a perspective view of one embodiment of the candle support apparatus.

The subject matter which I regard as my invention is particularly pointed out and distinctly claimed in the claims. The structure and operation of my invention, together with further objects and advantages, may be better understood from the following description given in connection with the accompanying drawings, in which:

FIG. 1 shows a perspective view of the candle support apparatus 10, wherein at least two resilient arms 20 extend from the candle support apparatus 10. Preferably, three resilient arms 20 are equally spaced about the candle socket 30. More than three resilient arms 20 may also be used to suit design or manufacturing preference.

Figure 2A:
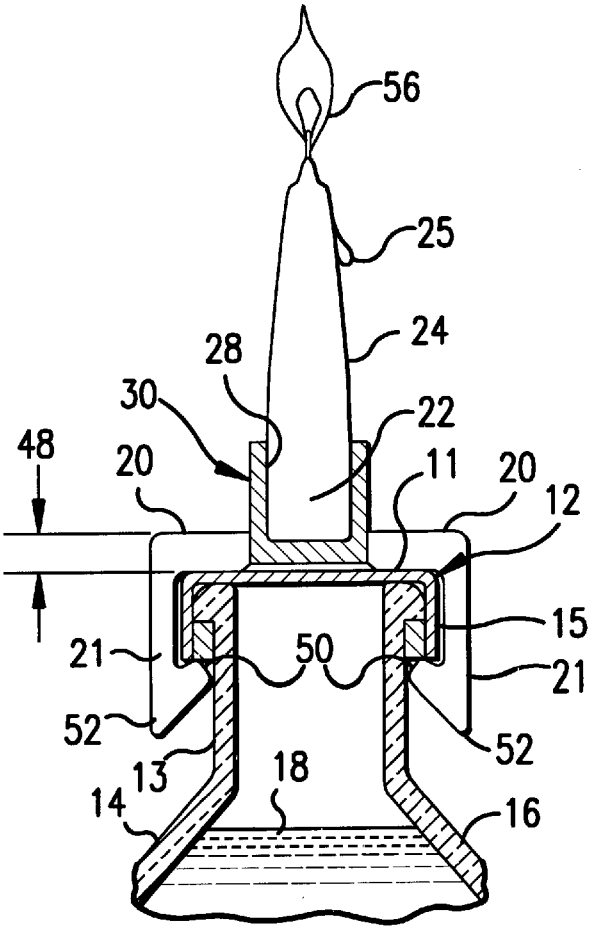
FIG. 2A is an elevational view of the embodiment of the candle support apparatus shown in FIG. 1, wherein the candle support apparatus is secured to an unopened cap located upon the neck of a bottle.

FIG. 2A shows a cross sectional view of the candle support apparatus 10, supported upon the cap 12 of an unopened bottle 14, such as a beverage bottle 16, having a liquid 18 contained therein.

The candle support apparatus 10 is preferably made of a resilient material, such as metal or plastic, which is sufficiently resilient to flexibly engage the outer periphery of an unopened bottle cap 12 which has been previously secured about the neck 13 of an unopened bottle 14.

The candle support apparatus 10 of the first embodiment is preferably molded into the desired shape prior to use, as best shown in FIG. 1.

Figure 2B:
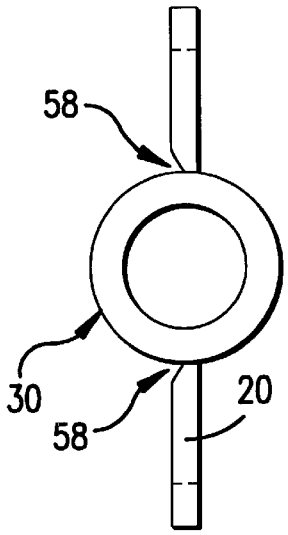
FIG. 2B is a top view of the candle support apparatus shown in FIG. 2A.

As best shown in FIG. 2A and FIG. 2B, at least two resilient arms 20 are sized to extend across the top 11 of the cap 12 with depending arms 21 positioned to extend down the crimped sides 15 of the cap 12. Inclined tabs 50 are positioned to flex during insertion of the candle support apparatus over the crimped sides 15 of the unopened cap 12, and to slip beneath the crimped sides 15 upon full insertion of the candle support apparatus 10 about the unopened cap 12, to retain and support the base 22 of a suitable candle 24 within the candle socket 30. The candle socket 30 is sized to closely receive the base 22 of a suitable candle 24 therein.

The candle 24 is preferably a dripless candle, but a drip catching disc 26 may be secured about the candle socket 30 to catch any wax which may drip 25 from the candle 24 during use.

Figure 6:
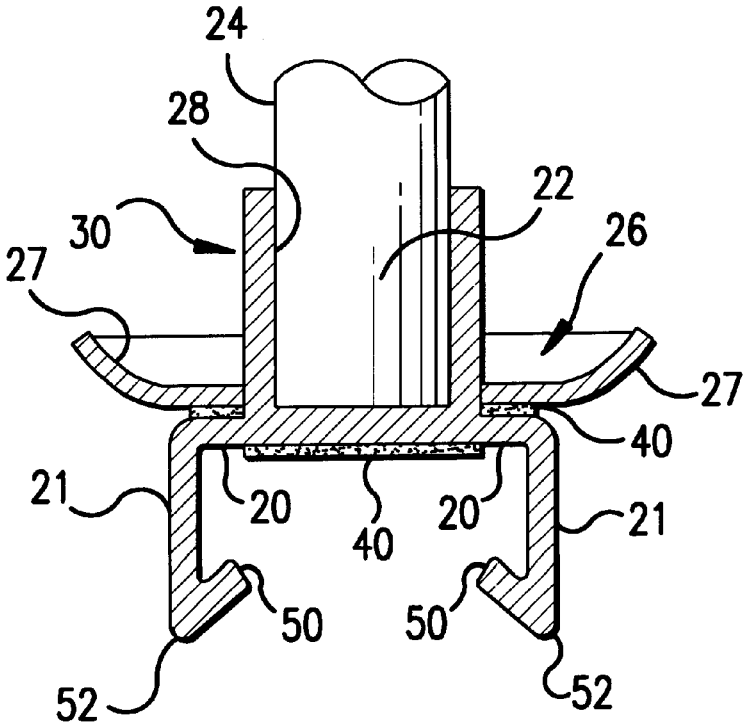
FIG. 6 is a cross sectional view of the candle support apparatus of FIG. 2A, wherein the outer periphery of the disc is raised to better retain the dripping candle wax.

The drip catching disc 26 shown in FIG. 6, preferably has a raised outer periphery 28 to better retain the dripping candle wax 25 during use.

At least two elongated, resilient arms 20 are preferably sized to extend across the top 11 of the cap 12. Each resilient arm has a depending arm portion 21 which extends down the crimped sides 15 of the unopened bottle cap 12. Each depending arm portion 21 has an inclined tab 50 which is inwardly disposed at the distal end of each depending arm portion 21.

Two, three, four or more elongated finger means 20 may be employed without departing from the spirit of this invention, or the scope of the following claims.

The resilient arms 20 are preferably narrower in width 46 than in height 48 so that the resilient arms 20 will flex during downward finger pressure, or selectively break off upon exertion of sideways finger pressure, thus enabling this candle support apparatus 10 to be used either on unopened bottle caps 12 or upon larger objects 31, such as beverages or gifts in containers 38.

Figure 3:
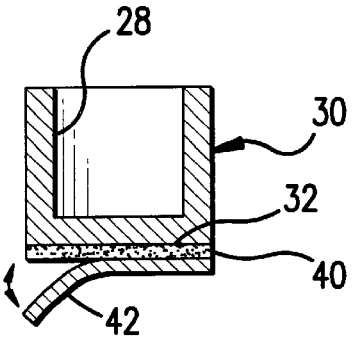
FIG. 3 is a cross-sectional view of a second embodiment of the candle support apparatus, wherein the candle support apparatus is adapted to be adhesively secured to a supporting object.

As best shown in FIG. 3, an adhesive 40, such as a pressure sensitive adhesive, may be secured to the bottom side 32 of the candle socket 30, to secure the candle socket 30 to a suitable package 34, jar 36 or other container 38. Where an adhesive 40 is used, a protective cover 42 may be employed to cover and protect the adhesive 40 prior to use. Where a protective cover 42 is used, it is removed prior to securement of the candle support apparatus 10 to the suitable object 31. A double sided adhesive tape 44 may also be used, to secure the candle support apparatus 10 directly to the top of a suitable package 34, jar 36 or other container 38.

Where a drip catching disk 26 is used, the adhesive 40 may be secured directly beneath the disk 26, to enable the adhesive 40 to be directly secured against the package 34, jar 36, or other container 38. The candle socket 30 may be secured directly above the disc 26, or the drip catching disc 26 may extend from the outer periphery of the candle socket 30. The disc 26 may include a raised portion 27 at the outer periphery of the disc 26, to better retain the candle drips 25 from the candle 24. The use of adhesive 40 to secure the candle socket 30 is especially useful where a cork, or other type stopper (not shown), is used in place of a standard size crimped bottle cap 12.

Figure 4:
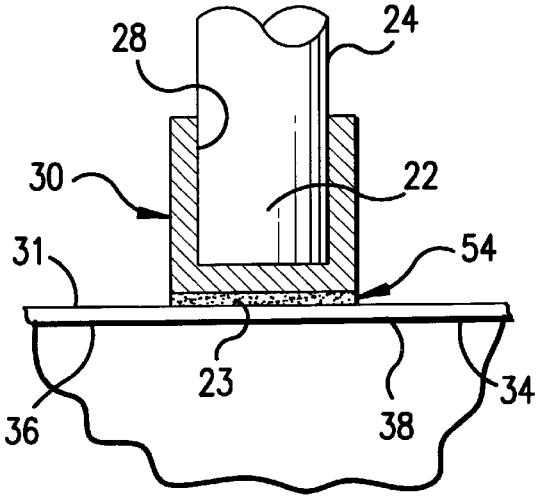
FIG. 4 is a cross sectional view of the second embodiment of the candle support apparatus shown in FIG. 3, wherein the candle support apparatus is secured to a suitable object.
Figure 5:
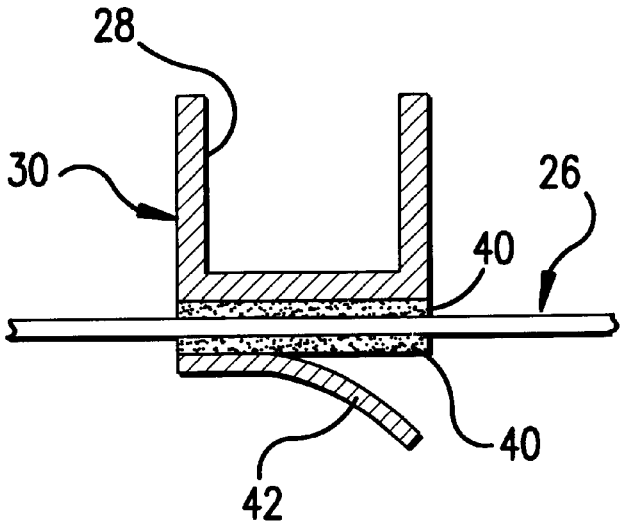
FIG. 5 is a cross sectional view of the first or second embodiment of the candle support apparatus, showing the use of a disc positioned beneath the candle base support means to catch dripping candle wax.

As shown in FIG. 3, FIG. 4 and FIG. 5, the candle socket 30 may be secured directly to the top of a package 34, jar 36, or container 38 with adhesive 40. The adhesive may be pre-applied to the bottom side 32 of the candle socket 30, or to the bottom side of the drip catching disc 26, as previously disclosed.

Both the resilient arms 20 and the adhesive 40 may be used together to better secure the candle support apparatus 10 to an unopened bottle 14 having a crimped bottle cap 12.

Where the candle support apparatus 10 is to be secured directly to a package 34, jar 36 or container 38, the resilient arms 20 may be easily broken off with sideways finger pressure against the narrow width 46 of the resilient arms 20. A detent 58 positioned as shown in FIG. 2B aids in the removal of the resilient arms 20 from the candle socket 30.

With the resilient arms 20 thus removed by sideways finger pressure, the candle support apparatus 10 may be easily secured to a selected package 34, jar 36 or container with adhesive 40, as best shown in FIG. 4.

Alternately, the candle support apparatus may be separately manufactured in accordance with the first and second embodiments noted herein, and the first or second embodiment of the candle support apparatus 10 selected according to the type of bottle 14, package 34, jar 36, or container 38 to be used.

The candle support apparatus 10 disclosed herein, is useful for presenting a gift contained in a bottle 16, jar 35, package 33 or container 35.

As best shown in FIG. 2A, the candle support apparatus 10 is placed upon the top of an unopened bottle 14, and secured to the crimped sides 15 of the bottle cap 12, as the depending arm portions 21 of the resilient arms 20 flex to engage the unopened bottle cap 12. The depending arm portions 21 of the resilient arms 20 flex to pass over opposing portions of the crimped sides 15 of the bottle cap 12, as the candle support apparatus 10 is mounted upon the unopened bottle cap 12 with downward finger pressure.

Inclined tabs 50 at the distal ends 52 of the depending arms 21, are positioned to slip beneath the crimped sides 15 of the unopened cap 12 as the candle support apparatus 10 is fully inserted onto the cap 12 with downward finger pressure, to securely position and hold the candle support apparatus 10 upon the unopened bottle cap 12.

Where the candle support apparatus 10 is intended for attachment to an unopened bottle 14 which does not have a crimped bottle cap 12, the candle support apparatus 10 may be secured to the unopened bottle by means of a suitable adhesive 40. Adhesive 40 may be also used to secure the candle support apparatus 10 to a suitable container, such as a jar 35, package 33 or container 35. The adhesive 40 is preferably in the form of double sided tape 54, with one side secured to the candle support apparatus 10 and the other side secured to a suitable object 31, such as an unopened bottle 14, package, 34, jar 36 or container 38.

Both the resilient arms 20 and the adhesive 40 may be used together to doubly secure the candle support apparatus 10 to an unopened bottle having a cap.

Thus, the candle support apparatus 10 disclosed herein, is adaptable for supporting the base of a candle 22 to a variety of suitable objects 31, such as unopened beverage bottles 16, including those having crimped bottle caps, corks or other liquid retaining means. This candle support apparatus 10 is also adapted for use upon packages 33, jars 35, containers 37, etc.

Once the candle support apparatus 10 is secured as previously noted to a suitable object 31, the base 22 of a suitable candle 24 may be inserted into the candle socket 30.

The base of the candle 22 is supported by the candle socket 30 in an upright position above a selected suitable object 31. The candle 24 wick 56 is lit just prior to presentation, to provide a festive environment for presentation of the selected gift. The candle 24 is preferably a dripless candle, and promptly extinguished following the presentation of the gift.

Where a dripless candle 24 is used, no drip catching disc 26 is required. Where a candle 24 is used that drips 25 during use, it is preferred to incorporate a drip catching disc 26 beneath or adjacent to the candle socket 30. Preferably the drip catching disc 26 is secured between the candle socket 30 and the adhesive 40.

Other festive objects, such as sparklers (not shown) may also be used in place of a candle 24 by providing a suitable support material within the candle socket 30.

Multiple candles 24 or other festive objects may be used by placing a plurality of the candle support apparatus 10 upon one or more suitable objects 31. Where multiple beverage bottles 16 are selected for presentation, such as a four-pack or six-pack of beverages (not shown), the candle support apparatus 10 disclosed herein, may be placed upon the unopened cap 12 of each beverage bottle 16, or other suitable object 31.

Thus, while the novel candle support apparatus 10 has been fully disclosed and described herein, numerous modifications will become apparent to one of ordinary skill in this art, and such modifications are intended to be included within the scope of the following claims.

What is claimed is:

1. A candle holding apparatus, which comprises:

a) a candle socket sized to closely receive and support the base of a candle therein;

b) at least two elongated, resilient arms radially extending from the candle socket, the elongated resilient arms having a width substantially narrower than the height of the elongated resilient arms, the elongated resilient arms further having a resilient depending arm portion extending downwardly from the resilient arms, each resilient depending arm portion having an inclined tab inwardly disposed at the distal end of each depending arm.

2. The apparatus of claim 1, wherein a drip catching disk is secured adjacent to the candle socket, to catch dripping candle wax from the candle, while the candle is lit.

3. The apparatus of claim 2, wherein the disc secured adjacent to the candle socket, has upturned sides extending about an outer periphery of the disc, to better retain the dripping wax upon the disc, while the candle is lit.

4. The apparatus of claim 1, wherein at least three resilient arms extend radially from the candle socket in substantially equal arcuate spacing.

5. The apparatus of claim 1, wherein at least four resilient arms extend radially from the candle socket in substantially equal arcuate spacing.

6. The apparatus of claim 1, wherein a detent extends across the height of the resilient arms adjacent to the candle socket, for ease of breaking off the resilient arms with sideways finger pressure, and wherein an adhesive means is provided on the base of the candle socket for selective securement to an object without the use of the resilient arms.

7. The apparatus of claim 1, wherein said resilient arms are sized to break off from the candle socket upon the exertion of sideways finger pressure, and wherein an adhesive means is provided on the base of the candle socket for selective securement to an object without the use of the resilient arms, and for selective securement by both adhesive and the resilient arms where the selected object is an unopened bottle cap.

8. The apparatus of claim 7, wherein the adhesive means comprises double sided tape.

9. The apparatus of claim 7, wherein a drip catching disk is secured between the candle socket and the adhesive means.

10. The apparatus of claim 9, wherein the drip catching disk has an upturned side at the outer periphery of the drip catching disk to better retain drips from the candle when lit.

11. The apparatus of claim 7, wherein the adhesive means is a pressure sensitive adhesive.

12. A candle support apparatus, for securement about a variety of suitable objects, comprising:

a) a candle socket having a candle receiving aperture disposed therein;

b) an adhesive secured beneath the candle socket;

c) a protective cover covering the adhesive prior to use;

d) at least two resilient arms radially extending from the candle socket, each resilient arm having a resilient depending arm having an inwardly inclined tab extending from a distal end of said depending arm, said resilient arms each having a width substantially less than the height of each resilient arm, said resilient arms sized to break off from the candle socket upon the exertion of sideways finger pressure, wherein the protective cover is removed from the adhesive prior to securement of the candle support apparatus to the selected object for selective securement by adhesive without the use of the resilient arms, and for selective securement by both adhesive and the resilient arms where the selected object is an unopened bottle cap.

13. The apparatus of claim 12, wherein the adhesive is a pressure sensitive adhesive.

14. The apparatus of claim 12, wherein the adhesive is a double sided tape.

15. The apparatus of claim 12, wherein a disk is secured adjacent to the candle socket and extends radially from the candle socket to catch drips from the candle when lit.

16. The apparatus of claim 15, wherein the disk has an upturned outer periphery, to better retain drips from the candle when lit.

17. The apparatus of claim 12, wherein a detent extends across the height of the resilient arms adjacent to the candle socket, for ease of breaking off the resilient arms with sideways finger pressure.

18. The apparatus of claim 12, wherein at least three resilient arms extend radially from the candle socket.

19. The apparatus of claim 12, wherein at least four resilient arms extend radially from the candle socket.

20. The apparatus of claim 12, wherein the candle support apparatus is molded of plastic.

* * * * *